US007540248B2

(12) United States Patent
London

(10) Patent No.: US 7,540,248 B2
(45) Date of Patent: Jun. 2, 2009

(54) KICK BOAT

(76) Inventor: Stephen M. London, 3979 Glenview Ave., Arden Hills, MN (US) 55112-2822

( * ) Notice: Subject to any disclaimer, the term of this patent is extended or adjusted under 35 U.S.C. 154(b) by 28 days.

(21) Appl. No.: 11/820,685

(22) Filed: Jun. 20, 2007

(65) Prior Publication Data

US 2008/0314308 A1 Dec. 25, 2008

(51) Int. Cl.

| | |
|---|---|
| ***B63B 1/10*** | (2006.01) |
| ***B63B 1/12*** | (2006.01) |
| ***B63B 7/02*** | (2006.01) |
| ***B63B 17/00*** | (2006.01) |

(52) U.S. Cl. ..... 114/61.1; 114/61.24; 114/352; 114/363

(58) Field of Classification Search ..... 114/61.1–61.25, 114/292, 352–354, 347, 363
See application file for complete search history.

(56) References Cited

U.S. PATENT DOCUMENTS 979,557 A * 12/1910 Phillips ..... 114/61.15
2,917,754 A * 12/1959 Gunderson ..... 114/61.15
3,665,885 A * 5/1972 Javes ..... 114/61.2
D259,927 S * 7/1981 Norlund ..... D12/310
4,295,236 A * 10/1981 Upchurch ..... 114/357
4,768,454 A 9/1988 Selken
6,640,741 B1 11/2003 Myers

FOREIGN PATENT DOCUMENTS

| | | | |
|---|---|---|---|
| CA | 1193147 | | 9/1985 |
| GB | 2034253 A | * | 6/1980 |
| GB | 2119721 A | | 11/1983 |

* cited by examiner

*Primary Examiner*—Ajay Vasudeva
(74) *Attorney, Agent, or Firm*—Gerald E. Helget; Nelson R. Capes; Briggs and Morgan, P.A.

(57) ABSTRACT

A twin-hulled, single-person, collapsible boat, has a pair of open, canoe-shaped hulls; a removable, collapsible frame connecting the hulls together; and a removable, one-person seat assembly connected to the frame between the hulls.

10 Claims, 4 Drawing Sheets

KICK BOAT

BACKGROUND OF THE INVENTION

The present invention is related to a twin-hulled boat and in particular to a one-person, collapsible, twin-hulled boat with two open canoe-shaped hulls joined by a frame-seat assembly.

Although there are many small twin hulled boats, these boats have several disadvantages. All other twin hulled single person boats have either inflatable hulls or enclosed hulls of rigid material.

Inflatable boats are heavy, bulky, require inflating and pumping gear before they can be used. Transporting a single inflatable twin hulled boat requires that the boat be either deflated and then inflated with a pump before use or carried on top of the car or in the box of a pickup or trailer. Because of the bulk and design of twin hulled inflatable boats it's difficult to haul more than one of them in all but the largest pickups or sport utility vehicles. Rigid pontoon-like boats cannot be easily transported due to the sheer bulk of their design and must be either carried assembled or in specialized car top carrier frames. Previous boats are too wide to be carried on narrow forest trails.

There is a need for an easily-assembled, transportable, twin-hulled boat that addresses the above problems.

SUMMARY OF THE INVENTION

A twin-hulled, single-person, collapsible boat, has a pair of open, canoe-shaped hulls; a removable, collapsible frame connecting the hulls together; and a removable, one-person seat assembly connected to the frame between the hulls.

A principle advantage of the present invention is that the twin hulls have false bottoms that provide the hulls with reserve buoyancy.

Another principle advantage of the present invention is that the false bottoms give shape and rigidity to the hulls, allowing them to maintain their shape without any thwarts or braces.

Another principle advantage of the present invention is that the absence of thwarts and braces allows the hulls to be nested for transport or storage. Two or three of the boats can be carried on top of a car or SUV by removing the frames from the hulls and nesting the hulls in each other and stacking them on the top of the car and putting the frames either in the upright hulls or in the rear of the vehicle Another principal advantage of the present invention is that the open canoe-like hulls store more cargo than any of the inflatable boats or the closed kayak-style twin hulled boats that require gear to be strapped to the hull or stored in bags attached to the top of the hull. The present invention requires no special bags or fasteners to hold coolers, tackle boxes, fishing rods, nets, or any other gear. All equipment is stored close at hand in either of the open hulls.

Another principle advantage of the present invention is that it has a disassembleable frame-seat assembly that can be used to easily assemble the hulls. The frame-seat assembly also adds to the rigidity of the boat and helps to allow the use of thin light materials that make for a strong light boat.

Another advantage of the present invention is that it can also be carried on narrow forest trails where other boats are too wide by nesting the hulls and carrying them canoe style overhead and assembling them in seconds at the waters edge without any special equipment.

Another advantage of the present invention is that the strong rigid hulls allow for a more streamlined shape than inflatable boats, making it faster and more efficient in the water.

DETAILED DESCRIPTION OF THE PREFERRED EMBODIMENT

Figure 1:
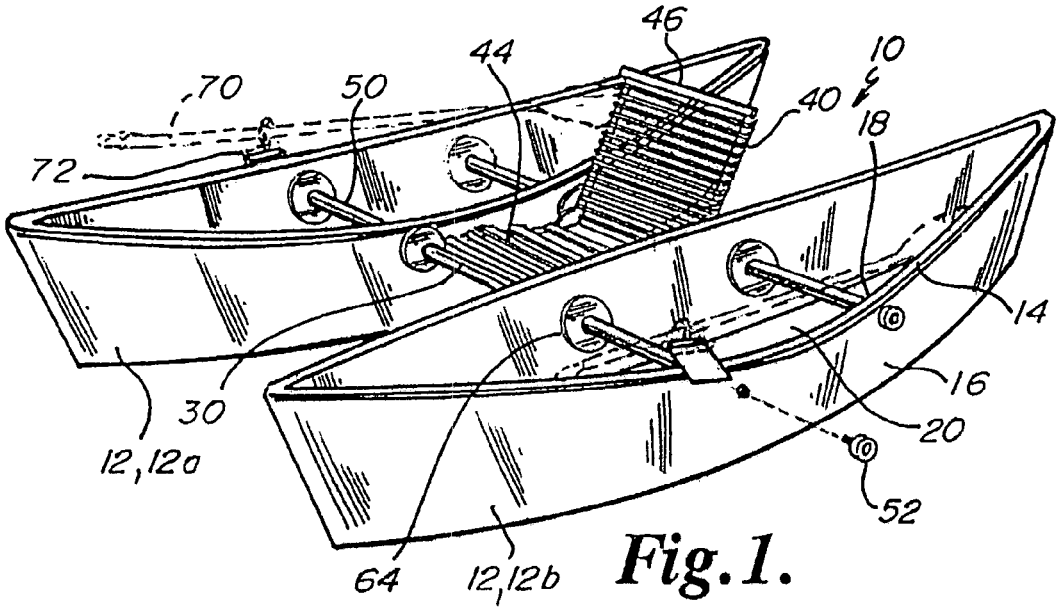
FIG. 1 is a perspective view of the present invention.

The present invention is generally designated in the Figures as reference numeral 10.

The present invention is a twin-hulled boat 10, which comprises a pair 12*a*, 12*b* of open, canoe-shaped hulls 12. The term "canoe-shaped" is clear from the drawings, but shall be defined herein as a boat with at least one, and preferably two, pointed ends. Each hull further comprises a pair of gunwales 14, two sides 16, and a floor 18. The gunwales 14 and floor 18 define a cargo space 20. The cargo space 20 is not enclosed between the gunwales, and hence is "open." The term "open" does not, however, exclude a temporary covering such as a tarp or canvas placed over the cargo space 20 for the purpose of keeping the cargo therein dry. Rather, "open" is intended to exclude such constructions as pontoons or kayaks with fully enclosed hulls.

The hulls may be made of any strong, light material such as wood, fiberglass, PVC, aluminum, etc. For aesthetic reasons, they are preferably made of wood.

Figure 2:
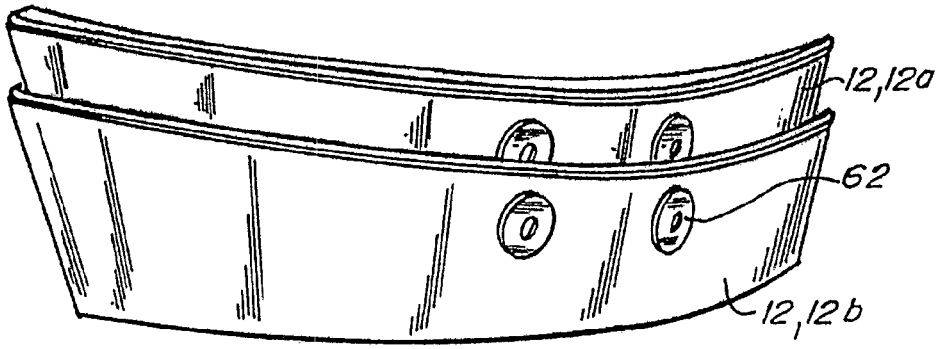
FIG. 2 is a perspective view showing stacking of the boats of the present invention.

Preferably, the hulls 12*a*, 12*b* do not have any thwarts or braces that would get in the way of storing supplies in the cargo space 20. Elimination of thwarts and braces also allows the hulls 12*a*, 12*b* to be stacked one on top of the other for storage or transport as seen in FIG. 2. To provide extra flotation and to add strength to the frame, the space beneath the floor 18 may be left filled with air. Alternative, flotation material, such as foam, may be inserted between the floor 18 and the inside surface of the boat 10.

The boat 10 further comprises a frame 30 connecting the hulls 12*a*, 12*b* together. While some embodiments of suitable frames are disclosed herein, this patent is not limited to the disclosed embodiments.

Figure 3:
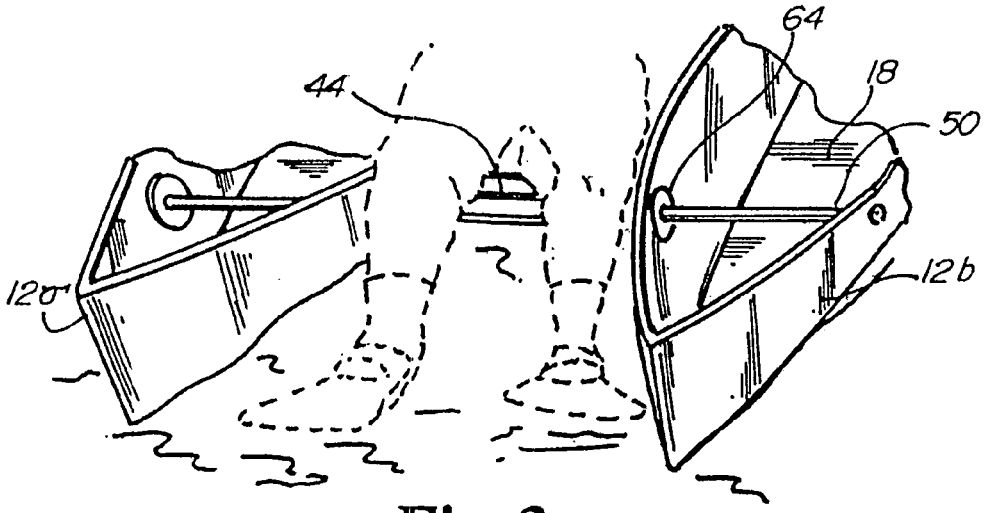
FIG. 3 is a perspective view of the present invention with an operator indicated in phantom.

The boat 10 further comprises a seat assembly 40 connected to the frame 30 between the hulls 12*a*, 12*b*. The operator sits on the seat assembly between the hulls while propelling the boat by oars, paddles, swim fins, or other suitable driving mechanisms. (FIG. 3)

In the preferred embodiment, the frame 30 is removable from the hulls 12*a*, 12*b* and the seat assembly 40, thereby allowing the hulls to be disconnected. To permit such a feature, the frame 30 further comprises a plurality of linking members 50 penetrating the hulls 12*a*, 12*b* transversely above the water line. The hulls 12*a*, 12*b* have suitable openings therethrough to permit passage of the linking members 50. Each linking member 50 has a removable connector 52 engaging the hulls, which, when fastened on the linking member against the hull, keeps the linking member in place.

Preferably, the linking members 50 are cylindrically shaped, although shapes with other cross-sections such as square, elliptical, etc. are possible. They may be made of any suitable, strong material such as wood, metal, fiberglass, PVC, aluminum, etc. For aesthetic reasons, the linking members 50 are preferably made of wood stained to match the wood of the hulls.

Figure 8:
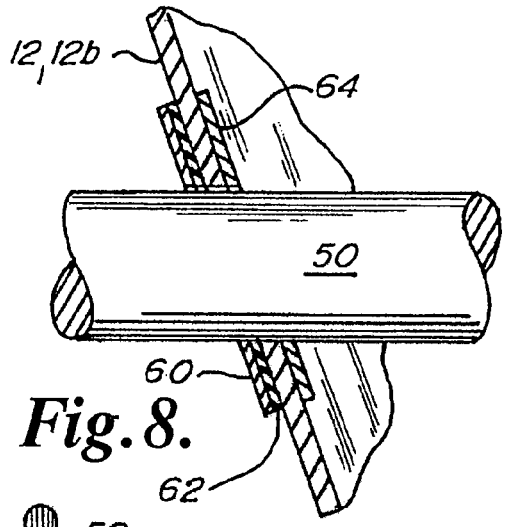
FIG. 8 is a cross-section of the inner hull of one of the hulls of the present invention, showing a gasket, gasket retainer, and reinforcing plate.
Figure 9:
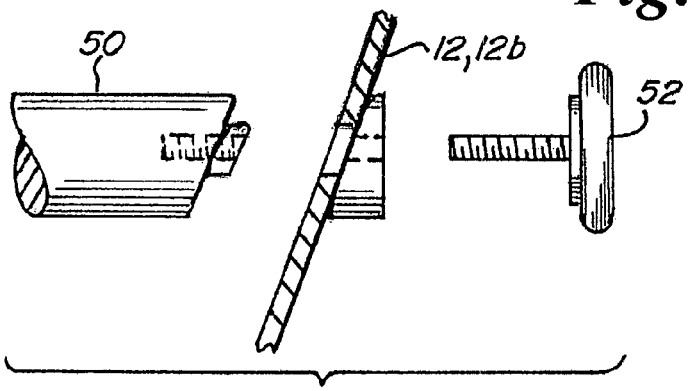
FIG. 9 is an exploded view of FIG. 8.
Figure 10:
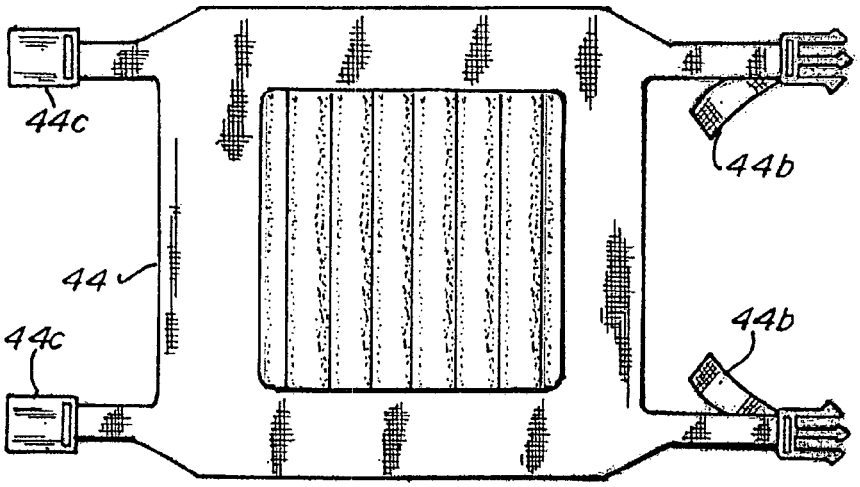
FIG. 10 is a top plan view of the seat of FIG. 4.
Figure 11:
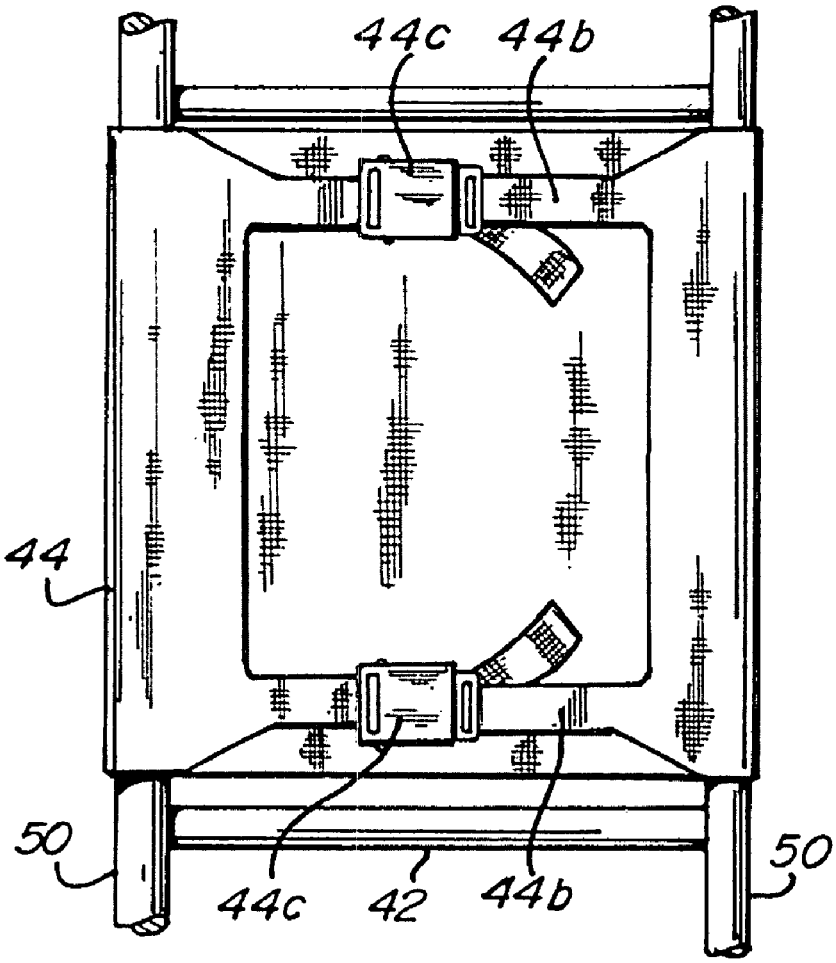
FIG. 11 is a bottom plan view of the seat of FIG. 4.
Figure 12:
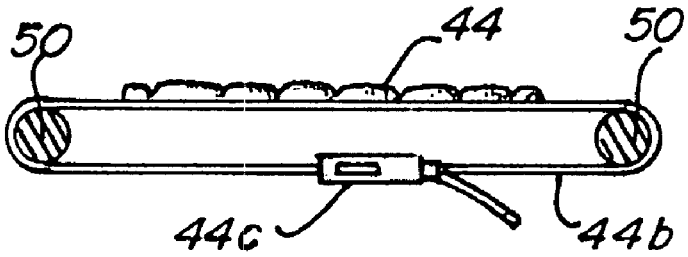
FIG. 12 is a side elevation view of the seat of FIG. 4.

Turning to FIG. 8, to make the connection between the linking members 50 and a hull watertight, the boat 10 preferably further comprises a gasket 60, gasket retainer 62, and reinforcing plate 64 enclosing the linking member 50 where it penetrates the hull through a reinforced hull aperture 66 and sandwiching the hull between the them.

The seat assembly 40 preferably further comprises a pair of seat supports 42 transversely engaging the linking members 50 and spaced from each other, a seat 44 engaging the linking members 50, and a seat back 46 engaging the linking members 50. The seat supports 42 may be permanently connected to the linking members so that the frame 30 is removed from the boat 10 as a unit. Alternatively, the seat supports 42 may be removable from the linking members 50. The seat 44 may also be removable from the linking members 50.

Figure 4:
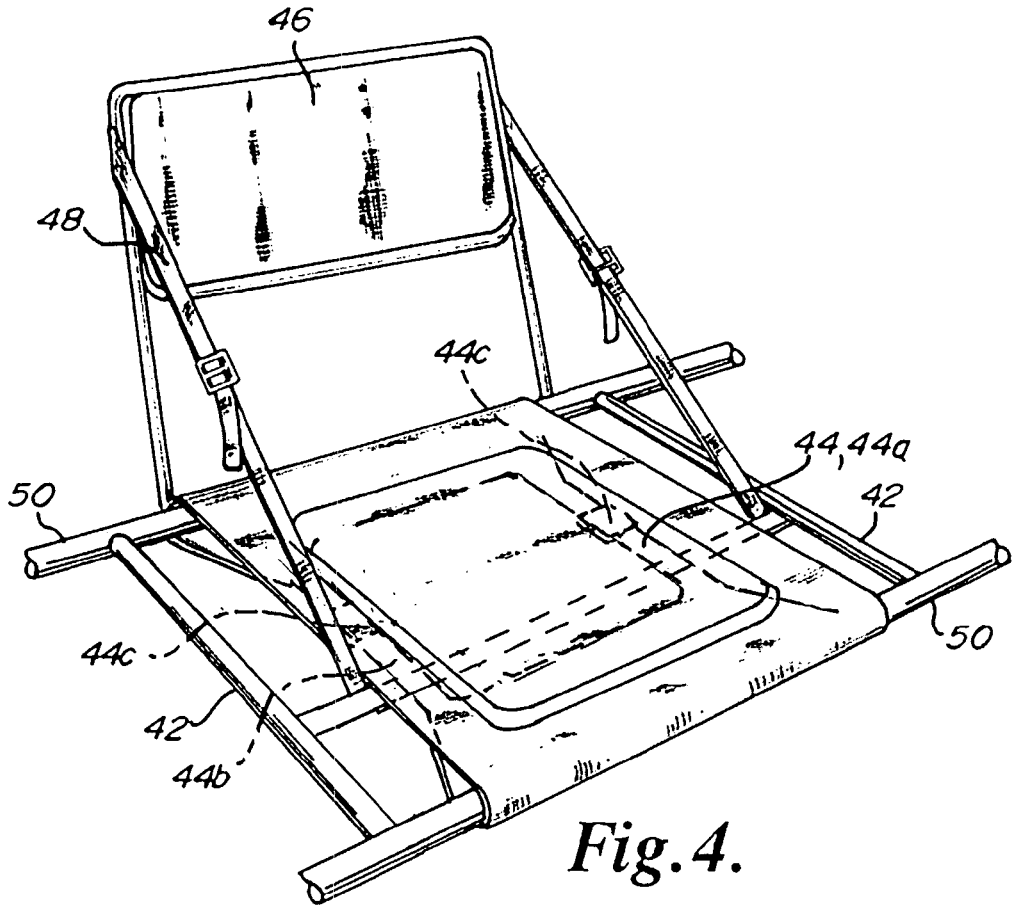
FIG. 4 is a perspective view of one embodiment of the seat assembly of the present invention.
Figure 5:
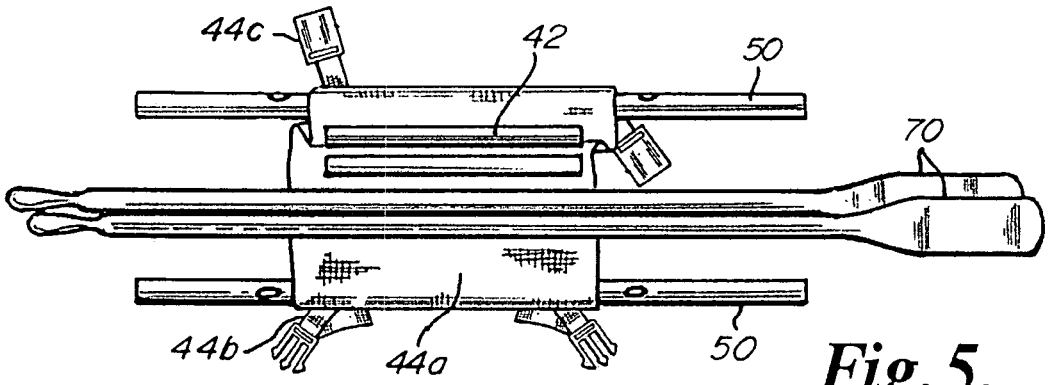
FIG. 5 is a top plan view of various parts of the present invention ready to be strapped together.
Figure 6:
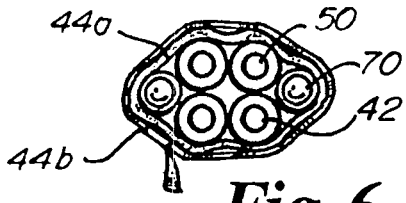
FIG. 6 is an end view showing the parts of FIG. 5 strapped together.
Figure 7:
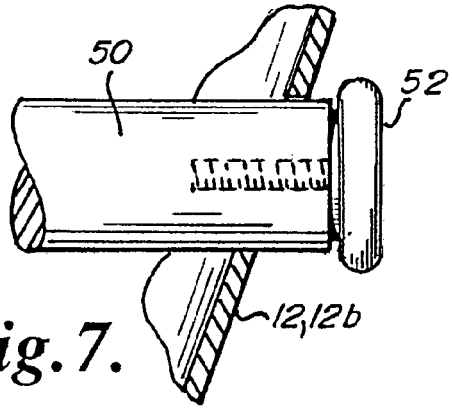
FIG. 7 is a cross-section through the outer hull of one of the hulls of the present invention, showing connection of a linking member to the hull.

Such an embodiment is shown in FIG. 4, where the seat 44 may be a sheet of material 44*a* that is placed over the linking members 50 and fastened in place. The Figure shows that this is preferably accomplished by a strap 44*b* and buckle 44*c* that tighten the seat material 44*a* in place on the linking members 50. The seat back 46 may be attached to the seat 44 by an adjustable strap 48 to adjust the tilt of the seat back. For ease of transportation and storage, the seat and strap may be used to enclose the linking members 50 and the seat supports 40, and optionally oars 70 as seen best in FIGS. 5 and 6. The package may then be stored in the bottom of one of the hulls.

To assemble the boat 10, the operator connects the linking members to the hulls by passing them through the reinforced hull apertures 66 and then tightening the connector 52 against one of the hulls. If the seat assembly is permanently attached to the linking members, the linking members 50 are then passed through the reinforced apertures 66 in the second hull and connectors 52 are tightened against the other hull. If the seat assembly is removable, the seat supports 42 are suitably secured to the linking members 50, for example by fasteners. The seat 44 is then attached to the linking members 50, for example, by tightening the strap 44*b* and fastening it with the buckle 44*c*. Alternatively, the seat 44 may have a sleeve (not shown) through which the linking members 50 are passed during the previous step.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A twin-hulled boat with a gunwale on each hull, comprising:

(a) a pair of open, canoe-shaped hulls;

(b) a frame connecting the hulls together; and (c) a seat assembly connected to the frame between the hulls;

(d) wherein the frame is removable from the hulls and the seat assembly, thereby allowing the hulls to be disconnected;

(e) wherein the frame further comprises a plurality of linking members penetrating the hulls transversely above the water line, each linking member having a removable connector engaging the hull;

(f) wherein the seat assembly further comprises a seat engaging one of the plurality of linking members and a seat back engaging another of the plurality of linking members, the seat assembly being positioned between the hulls and wherein the seat is below the gunwales (g) thereby permitting the boat to be paddled by a seated operator using swim fins.

2. The boat of claim 1, wherein the hulls contain no thwarts or braces.

3. The boat of claim 2, wherein one of the hulls stacks within the other hull.

4. The boat of claim 1, further comprising a gasket, gasket retainer, and reinforcing plate sandwiching one of the hulls therebetween and enclosing the linking member.

5. The boat of claim 1, wherein the seat assembly is removed from the linking members.

6. The boat of claim 1, wherein the linking members and the seat assembly can be strapped together for transport after the seat assembly is removed from the linking members and the linking members are removed from the hulls.

7. A twin-hulled, single-person, collapsible boat, with a gunwale on each hull, comprising:

(a) a pair of open, canoe-shaped hulls;

(b) a removable frame connecting the hulls together; and (c) a one-person seat assembly removably connected to the frame between the hulls, (d) wherein the frame is removable from the hulls, thereby allowing the hulls to be disconnected;

(e) wherein the frame further comprises a plurality of linking members penetrating the hulls transversely above the water line, each linking member having a removable connector engaging the hull;

(f) wherein the seat assembly further comprises a seat engaging one of the plurality of linking members and a seat back engaging another of the plurality of linking members, the seat assembly being positioned between the hulls and wherein the seat is below the gunwales (g) thereby permitting the boat to be paddled by a seated operator using swim fins.

8. The boat of claim 7, wherein the linking members and the seat assembly can be strapped together for transport after the seat assembly is removed from the linking members and the linking members are removed from the hulls.

9. A twin-hulled, single-person, collapsible boat with a gunwale on each hull, comprising:

(a) a pair of open, canoe-shaped hulls;

(b) a removable, collapsible frame connecting the hulls together; and (c) a one-person seat assembly removably connected to the frame between the hulls, (d) wherein the frame is removable from the hulls, thereby allowing the hulls to be disconnected;

(e) wherein the frame further comprises a plurality of linking members penetrating the hulls transversely above the water line, each linking member having a removable connector engaging the hull;

(f) wherein the seat assembly further comprises a seat engaging one of the plurality of linking members and a seat back engaging another of the plurality of linking members, the seat assembly being positioned between the hulls and wherein the seat is below the gunwales (g) thereby permitting the boat to be paddled by a seated operator using swim fins.

10. The boat of claim 9, wherein the linking members and the seat assembly can be strapped together for transport after the seat assembly is removed from the linking members and the linking members are removed from the hulls.

* * * * *

UNITED STATES PATENT AND TRADEMARK OFFICE

CERTIFICATE OF CORRECTION

PATENT NO. : 7,540,248 B2
APPLICATION NO. : 11/820685
DATED : June 2, 2009
INVENTOR(S) : Stephen M. London It is certified that error appears in the above-identified patent and that said Letters Patent is hereby corrected as shown below:

In column 4, line 41 please delete “removed”, and in its place --removable--.

Signed and Sealed this

First Day of September, 2009

David J. Kappos

David J. Kappos
*Director of the United States Patent and Trademark Office*